US011021870B1

(12) United States Patent
McKnight et al.

(10) Patent No.: US 11,021,870 B1
(45) Date of Patent: Jun. 1, 2021

(54) SOUND BLOCKING ENCLOSURES WITH ANTIRESONANT MEMBRANES

(71) Applicant: HRL LABORATORIES LLC, Malibu, CA (US)

(72) Inventors: Geoffrey P. McKnight, Los Angeles, CA (US); Chia-Ming Chang, Agoura Hills, CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 14/213,465

(22) Filed: Mar. 14, 2014

Related U.S. Application Data

(60) Provisional application No. 61/785,909, filed on Mar. 14, 2013.

(51) Int. Cl.
*G10K 11/172* (2006.01)
*E04B 1/84* (2006.01)

(52) U.S. Cl.
CPC ..... *E04B 1/84* (2013.01)

(58) Field of Classification Search
CPC . E04B 1/84; E04B 1/82; E04B 1/8218; E04B 2001/8263; E04B 2001/8272; E04B 2001/8281; G10K 11/002; G10K 11/16; G10K 11/172; F04B 39/0027; F04B 39/0033; F04B 39/0088
USPC ..... 181/291, 288, 198, 200, 202, 207, 208
See application file for complete search history.

(56) References Cited

U.S. PATENT DOCUMENTS 1,443,688 A * 1/1923 Hurd ..... 220/4.28
2,153,357 A * 4/1939 Wente ..... 181/291
2,541,159 A * 2/1951 Geiger ..... 181/208
2,796,636 A * 6/1957 Heerwagen ..... 52/144
3,117,575 A * 1/1964 Carrell et al. ..... 128/866
3,967,693 A * 7/1976 Okawa ..... G10K 11/16 181/284
3,997,020 A * 12/1976 Busnel ..... E04B 1/84 181/175
4,149,612 A * 4/1979 Bschorr ..... 181/286
4,177,876 A * 12/1979 Pujolle ..... 181/284
4,325,461 A * 4/1982 Bschorr ..... 181/286
4,347,043 A * 8/1982 Morris ..... 417/53
4,371,858 A * 2/1983 Kanoi et al. ..... 336/100
4,442,419 A * 4/1984 Kanoi et al. ..... 336/100
4,514,714 A * 4/1985 Kanoi et al. ..... 336/100
4,558,296 A * 12/1985 Thoren ..... 336/100
5,291,801 A * 3/1994 Hanada et al. ..... 74/606 R
5,521,341 A * 5/1996 Stief et al. ..... 181/295
5,583,316 A * 12/1996 Kitahara et al. ..... 174/16.3
5,587,564 A * 12/1996 Stief et al. ..... 181/295
5,760,349 A * 6/1998 Borchers ..... B64G 1/002 181/286
5,851,626 A * 12/1998 McCorry et al. ..... 428/95
6,478,110 B1 * 11/2002 Eatwell et al. ..... 181/207
6,604,603 B1 * 8/2003 Wirth ..... 181/200
7,249,653 B2 * 7/2007 Sheng et al. ..... 181/290
(Continued)

*Primary Examiner* — Edgardo San Martin
(74) *Attorney, Agent, or Firm* — Lewis Roca Rothgerber Christie, LLP

(57) ABSTRACT

An enclosure is disclosed. The enclosure contains a plurality of walls coupled together and configured to al least partially cover one or more components, wherein at least one of the walls comprises a first plurality of antiresonant membranes configured to at least partially block acoustic emission from the one or more components.

21 Claims, 10 Drawing Sheets

(56) References Cited

U.S. PATENT DOCUMENTS

| | | | | |
|---|---|---|---|---|
| 7,263,028 | B2 * | 8/2007 | Thomas et al. | 367/1 |
| 7,395,898 | B2 * | 7/2008 | Yang et al. | 181/286 |
| 7,400,501 | B2 * | 7/2008 | Bartell et al. | 361/695 |
| 7,510,052 | B2 * | 3/2009 | Ayle | 181/292 |
| 8,360,201 | B2 * | 1/2013 | Tanase | 181/291 |
| 8,408,356 | B2 * | 4/2013 | Yamaguchi et al. | 181/198 |
| 8,616,330 | B1 * | 12/2013 | McKnight et al. | 181/207 |
| 8,662,246 | B2 * | 3/2014 | Classen et al. | 181/200 |
| 8,752,667 | B2 * | 6/2014 | McKnight et al. | 181/287 |
| 8,835,883 | B2 * | 9/2014 | Muto et al. | 250/492.3 |
| 8,857,563 | B1 * | 10/2014 | Chang et al. | 181/286 |
| 8,857,564 | B2 * | 10/2014 | Ma et al. | 181/286 |
| 8,869,933 | B1 * | 10/2014 | McKnight et al. | 181/286 |
| 9,275,622 | B2 * | 3/2016 | Claeys | G10K 11/172 |
| 9,466,283 | B2 * | 10/2016 | Yang | G10K 11/175 |
| 9,711,129 | B2 * | 7/2017 | Sheng | G10K 11/02 |
| 2008/0099609 | A1 * | 5/2008 | Drost | 244/119 |
| 2008/0135327 | A1 * | 6/2008 | Matsumura et al. | 181/151 |
| 2011/0240402 | A1 * | 10/2011 | Chou et al. | 181/207 |

* cited by examiner

SOUND BLOCKING ENCLOSURES WITH ANTIRESONANT MEMBRANES

CROSS REFERENCE TO RELATED APPLICATIONS

This application claims the benefit of U.S. Provisional Application No. 61/785,909, filed on Mar. 14, 2013, which is incorporated herein by reference in its entirety.

FIELD

The present invention relates to sound blocking enclosures and more particularly to sound blocking enclosures with antiresonant membranes.

BACKGROUND

Noise has long been regarded as a harmful form of environmental pollution mainly due to its high penetrating power. Typically the performance of a noise shielding enclosure to control noise is governed by the sound transmission loss of the barriers along with level of acoustic energy dissipation (absorption) incorporated into the enclosure. For the enclosure walls, the current noise shielding solutions are directly tied to the mass of the barrier. In general, noise transmission for walls is governed by the mass density law, which states that the acoustic transmission T through a wall is inversely proportional to the product of wall thickness l, the mass density ρ, and the sound frequency f. Hence doubling the wall thickness will only add (20 log 2=) 6 dB of additional sound transmission loss (STL), and increasing STL from 20 to 40 dB at 100 Hz would require a wall that is eight times the normal thickness. IKn enclosure design the efficacy is determined by the insertion loss which is the amount of acoustic attenuation with the enclosure in place as compared to without the enclosure. In general the maximum insertion loss is limited to the STL of the enclosure walls.

Referring to FIG. 1, an enclosure 100 is shown around a pump and/or motor 110. The enclosure 100 comprises walls to contain acoustic energy along with foam or fibrous material 120 to provide acoustic absorption for trapped acoustic energy from the motor 110. The foam material 120 is positioned to cover the internal walls of the enclosure 100 and provides an absorption coefficient of between 0.1 and 10. The performance of this enclosure limited by the sound transmission loss of the enclosure walls which is tied to the mass per unit area of the panels for conventional treatments.

The prior art discloses different approaches to achieving at least partial sound transmission losses. For example, U.S. Pat. No. 7,510,052 discloses a sound absorption honeycomb based on modified Helmholtz resonance effect. This type of solution can provide effect absorption but does not increase the sound transmission as required in enclosure application. U.S. Application 20080099609 discloses a tunable acoustic absorption system for an aircraft cabin that is tuned by selecting different materials. The invention specifically calls out a barium titanate loaded membrane that provides mass law sound transmission behavior. Therefore, the structures disclosed in U.S. Application 20080099609 are heavy and bulky. U.S. Pat. No. 7,263,028 discloses embedding a plurality of particles with various characteristic acoustic impedances in a sandwich with other light weight panels to enhance the sound isolation. Although it could be lighter or thinner than traditional solid soundproofing panels, it operates over a relatively narrow frequency range and doesn not provide a significant improvement over the mass law due to the influence of the matrix vibrations. U.S. Pat. No. 7,249,653 discloses acoustic attenuation materials that comprise an outer layer of a stiff material which sandwiches other elastic soft panels with an integrated mass located on the soft panels. By using the mechanical resonance, the panel passively absorbs the incident sound wave to attenuate noise. This invention has a wire mesh barrier that does not effective decouple adjacent cells leading to poor performance in the case of a close fitting enclosure. U.S. Pat. Nos. 4,149,612 and 4,325,461 disclose silators. A silator is an evacuated lentiform (double convex lens shape) with a convex cap of sheet metal. These silators comprise a compliant plate with an enclosed volume wherein the pressure is lower than atmospheric pressure to constitute a vibrating system for reducing noise. To control the operating frequency, the pressure enclosed in the volume coupled with the structural configuration determines the blocking noise frequency. The operating frequency dependence on the pressure in the enclosed volume makes the operating frequency dependent on environment changes such as temperature. U.S. Pat. No. 5,851,626 discloses a vehicle acoustic damping and decoupling system. This invention includes a bubble pack which may be filled with various damping liquids and air to enable the acoustic damping. It is a passive damping system dependent on the environment. Finally, U.S. Pat. No. 7,395,898 discloses an antiresonant cellular panel array based on flexible rubbery membranes stretched across a rigid frame. However, the materials disclosed in U.S. Pat. No. 7,395,898 limit the bandwidth to about 200 Hz and a single attenuation frequency and require completely rigid frames which are impractical to achieve for many applications.

Embodiments disclosed in the present disclosure overcome the limitations of the prior art and provide improved insertion loss.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

The prior art in architected barriers discussed above does not consider the use of these barriers in enclosures. For enclosures there are different concerns including the proximity of the noise component, the thermal and moisture conditions, the integration of damping, and the multifunction of the enclosure stiffness and other functions with its acoustic performance. As discussed above, the prior art is limited to rubber materials which have potential issues with fluid exposure degradation, sensitivity to thermal fluctuations and flammability and toxicity concerns. Further to reach higher frequency with soft rubber materials, one must use very small cell sizes which leads to large system weight.

Contrary to the prior art, in some embodiments, the presently disclosed enclosures may use rigid or semi-rigid polymers as well as metal foils to reach higher frequencies common to small and mid-size components. In some embodiments, the presently disclosed enclosures comprise antiresonant membranes which provide improved bandwidth over previously disclosed concepts and also have the ability to target a primary tone and its multiple harmonic tones that is common in components that emit tonal acoustic emission.

Antiresonant membranes are disclosed in more detail in U.S. application Ser. No. 13/645,250, filed on Oct. 4, 2012, which is incorporated herein by reference in its entirety. Antiresonant membranes are disclosed in more detail in U.S. Pat. No. 7,249,653, granted on Jul. 31, 2007, which is incorporated herein by reference in its entirety.

Figure 1:
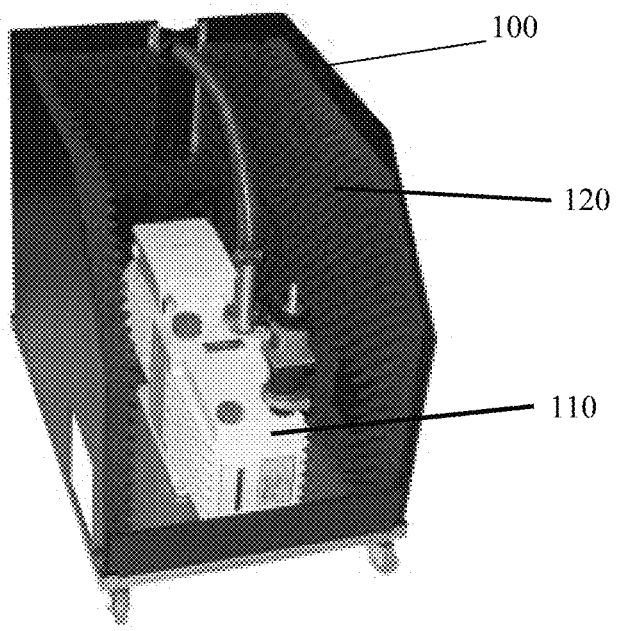
FIG. 1 Prior Art
FIG. 1 depicts an enclosure as known in the art.
Figure 2:
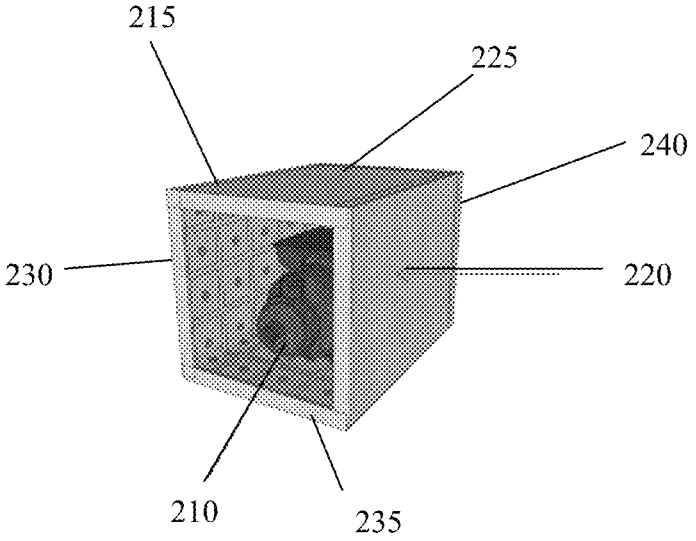
FIG. 2 depicts an embodiment according to the present disclosure.

Referring to FIG. 2, in some embodiments, a component 210 is encased in an enclosure 215 according to the present disclosure. The component 210 is any device that emits noise. For example, the component 210 is a pump or a motor. The enclosure 215 comprises side walls 220 and 230, top and bottom walls 225 and 235 and a rear wall 240. Front wall (the wall that is opposite the rear wall 240) of the enclosure 215 is not shown for ease of reference.

In some embodiments, the enclosure 215 may be configured to perform one or more of the following functions: mounting of the component 210, thermal mitigation, physical protection of the component 210, and acoustic performance. The design of the acoustic function may be dependent on other system constraints for example sufficient cooling or packaging size.

In some embodiments, at least one the walls 220, 225, 230, 235, 240 comprises an array of antiresonant membranes with acoustic reflection properties (or purely of antiresonant array materials). In some embodiments, at least one of the walls 220, 225, 230, 235, 240 comprises traditional enclosure materials (such as, for example, sheet metal).

Figure 3A:
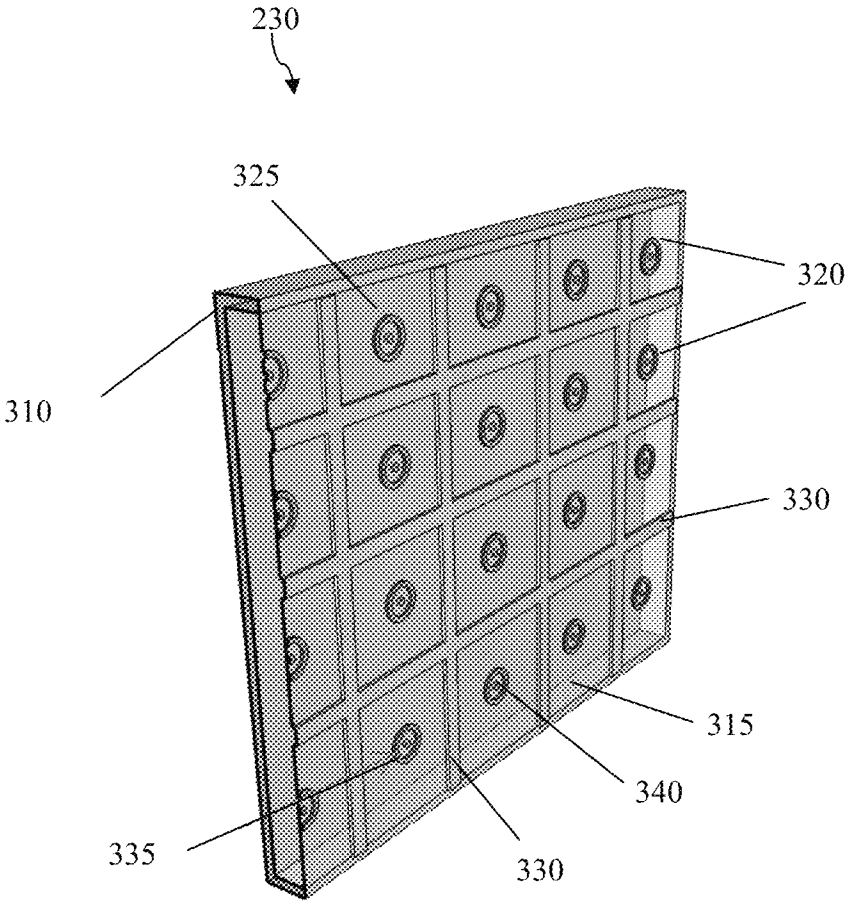
FIG. 3*a* depicts another embodiment according to the present disclosure.

Referring to FIG. 3*a*, in some embodiments, the wall 230 comprises an outer panel 310 and an inner barrier layer 315. The outer panel 310 forms the outer surface of the wall 230 and the inner barrier layer 315 forms the inner surface of the wall 230. In some embodiment, the outer panel 310 is made out of, for example, sheet metal.

In some embodiments, the barrier layer 315 is an array of resonators 320 (shown in FIGS. 3*a* and 3*b*) in the form of membranes 325. In some embodiments, the membranes 325 are defined by a grid structure 330 that specifies the length and width of the resonators 320 and provides a backing which counters any tension within the membranes 325.

Figure 3B:
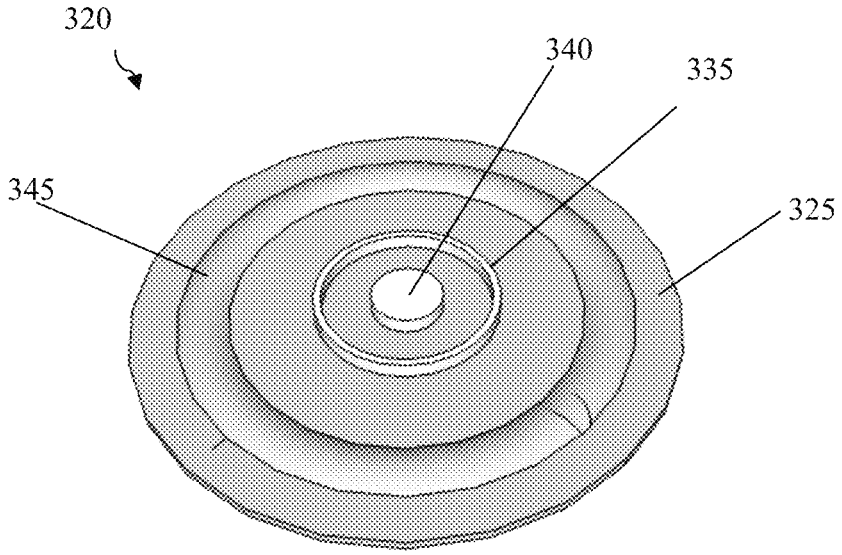
FIG. 3b PRIOR ART
FIG. 3*b* depicts an embodiment of a membrane as known in the art.
Figure 4A:
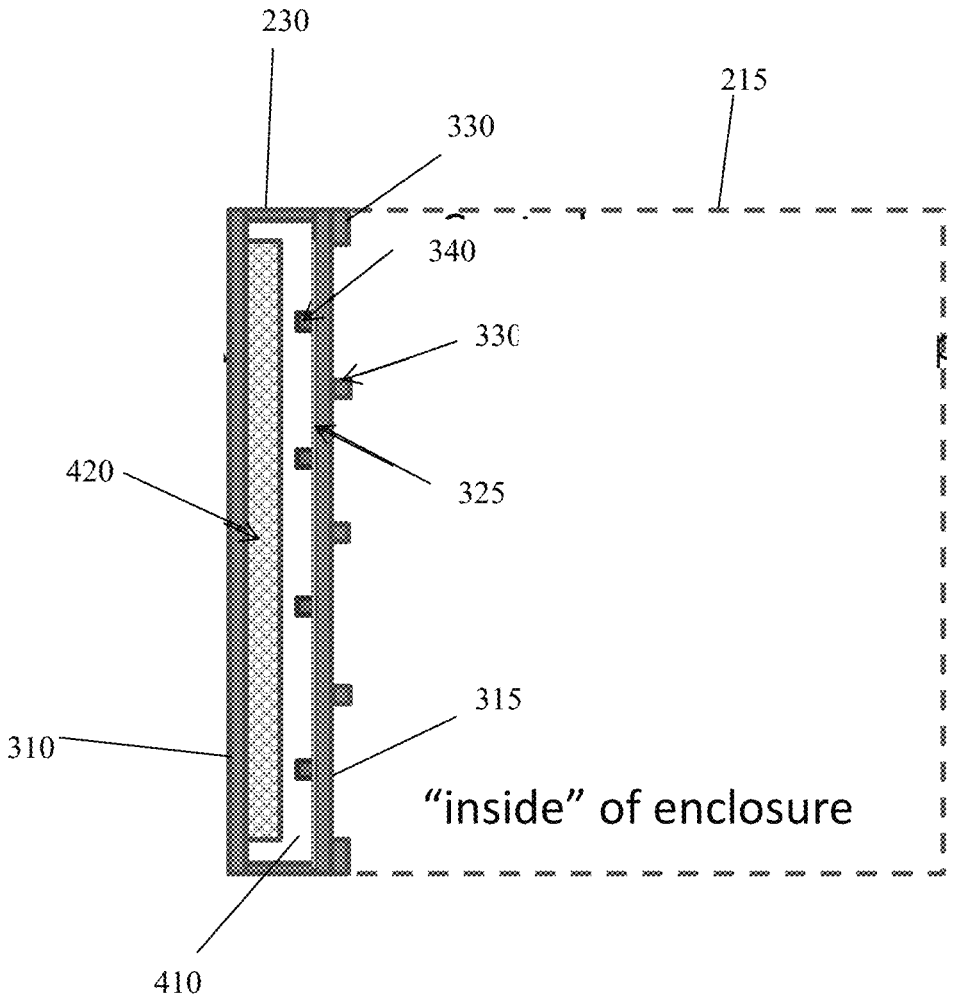
FIG. 4*a* depicts an embodiment of a wall according to the present disclosure.
Figure 4B:
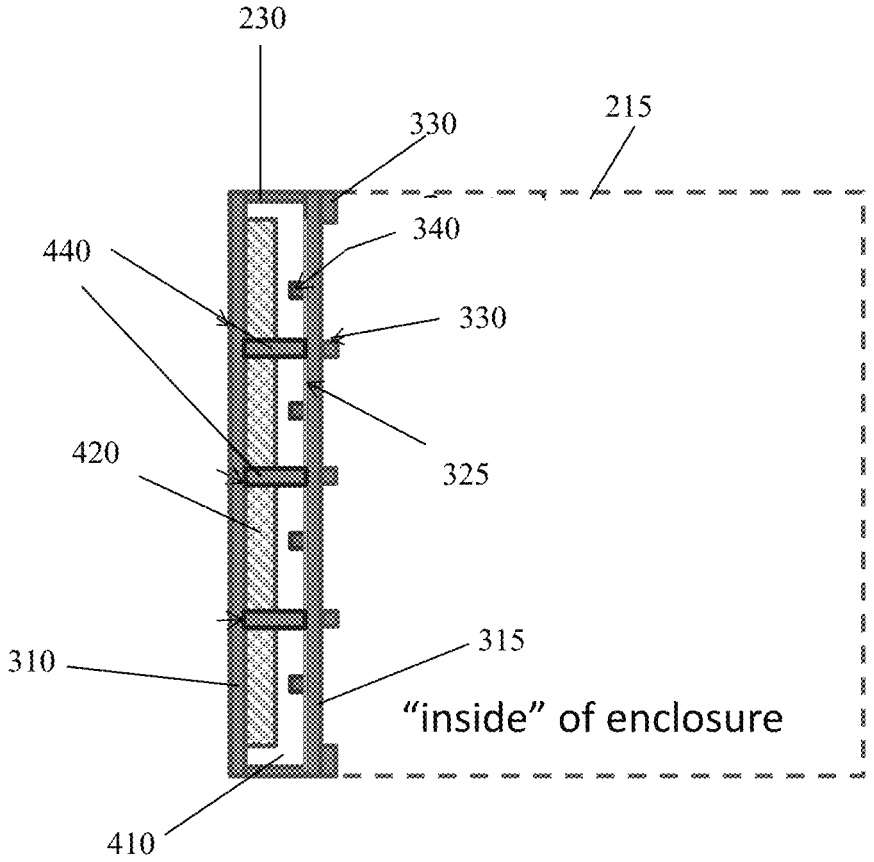
FIG. 4*b* depicts another embodiment of a wall according to the present disclosure.
Figure 5:
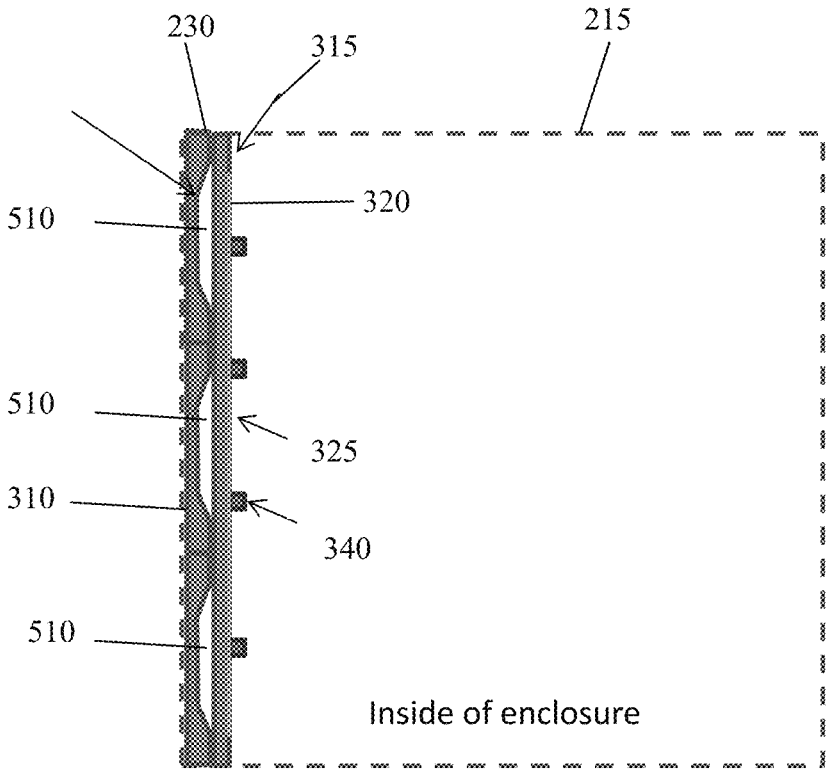
FIG. 5 depicts another embodiment of a wall according to the present disclosure.

In some embodiments, the membranes 325 comprise a ring 335 and a mass 340 (as shown in FIGS. 3*a-b*) which can be used to create two separate reflection frequency bands (i.e. antiresonances). In some embodiments, the membranes 325 comprise the mass 340 without the ring 335. It is to be understood that the membranes 325 may comprise other central mass configurations. In one embodiment, the ring 335 and/or the mass 340 are disposed between the membrane 325 and the outer panel 310 (as shown in FIG. 4*a*). In another embodiment, the ring 335 and/or the mass 340 are disposed on the surface of the membrane 325 facing away from the outer panel 310 (as shown in FIG. 5). In some embodiments, the membrane 325 comprises a hinge structure 345 as shown in FIG. 3*b*. Different membrane structures are disclosed in more detail in U.S. application Ser. No. 13/645,250, filed on Oct. 4, 2012, which is incorporated herein by reference in its entirety.

Different embodiments of the wall 230 are disclosed below with reference to FIGS. 4*a-c* and 5-6. Referring to FIG. 4*a*, in some embodiments, the wall 230 of the enclosure 215 (marked by dotted line) defines a cavity 410 formed by of the barrier layer 315 and the panel 310. The cavity 410 is configured to allow the resonators 320 to function by allowing the membranes 325 to deflect towards and away from the panel 310.

In some embodiments, the wall 230 comprises an absorber material 420 disposed within the cavity 410 to at least partially dissipate trapped acoustic energy. In some embodiments, the barrier layer 315 does not absorb energy, but rather reflects energy. In this embodiment, the absorber material 420 may be used to absorb and/or reduce energy not reflected by the barrier layer 315. The absorber material 420 is incorporated in a way which does not interfere with the operation of the resonators 320. In some embodiments, standoffs (not shown) or other means may be used to control position of the absorber material 420. In some embodiments, the absorber material 420 is foam, fiber mat, foam of fibrous blanket or a porous material. In some embodiment, a Helmholtz absorber (not shown) which is a tuned helmholtz cavity, combined with a porous absorber which creates a strong absorption effect over a relatively narrow band may be used together with the wall 230.

Figure 4C:
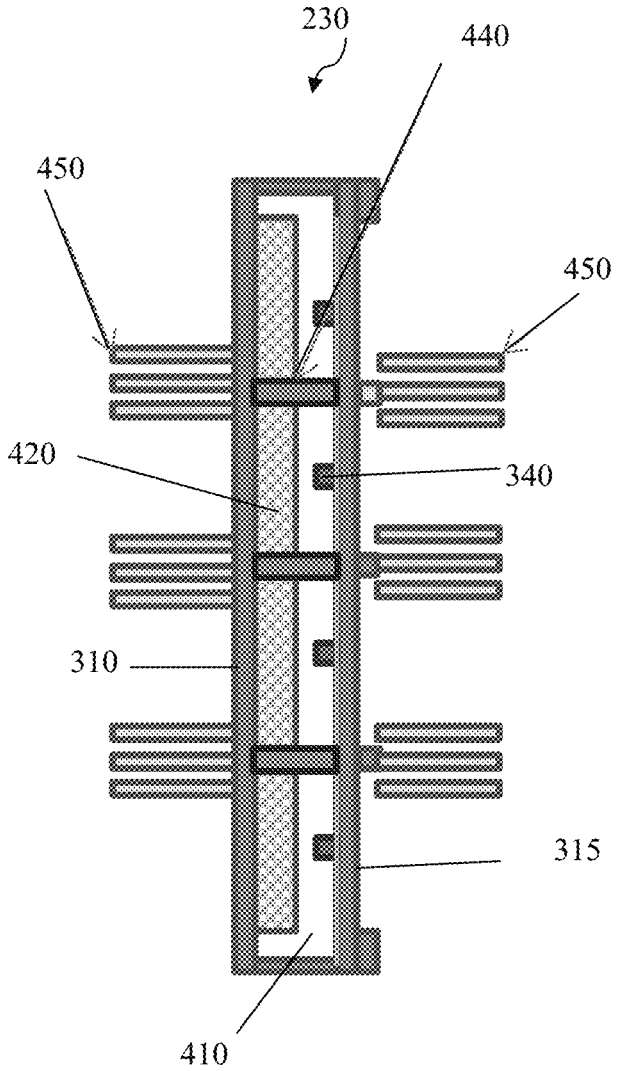
FIG. 4*c* depicts another embodiment of a wall according to the present disclosure.
Figure 4D:
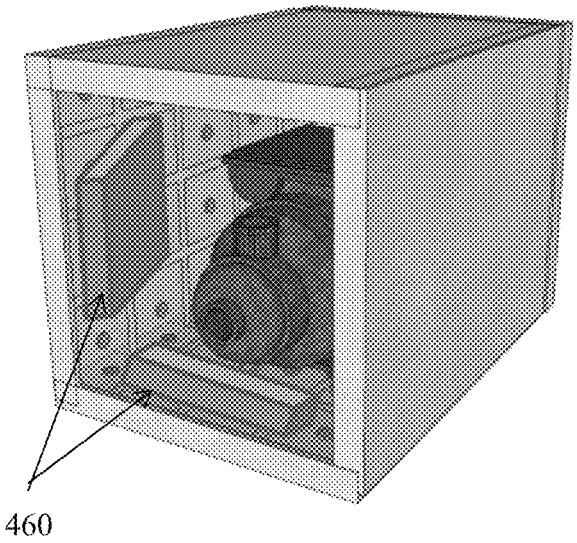
FIG. 4*d* depicts another embodiment according to the present disclosure.

In some embodiments, an absorber material 460 is disposed on the mass 340 (as shown in FIG. 4*d*) to at least partially dissipate trapped acoustic energy.

In some embodiments, the barrier layer 315 spans the entire wall distance by coupling to the panel 310 only at the edges as shown in FIG. 4*a*. In some embodiments, one or more damping posts 440 (shown in FIG. 4*b*) are used to provide additional support for the barrier layer 315. In some embodiments, the damping posts 440 are rigid mounts that are part of the barrier layer 315 and/or part of the panel 310. In some embodiments, the damping posts 440 are used for walls 230 about 12 feet high or larger. In some embodiments, the damping posts 440 are soft supports such as rubber or viscoelastic materials for providing marginal coupling to the barrier layer 315 and/or the panel 310. Using a viscoelastic material for the damping posts 440 may damp vibrations in the barrier layer 315, yielding better acoustic performance since unwanted vibrations can degrade the effectiveness of the barrier layer 315.

Referring to FIG. 4*c*, in some embodiments, the wall 230 comprises one or more heat sync elements 450 to aid in heat transport through the wall 230. In some embodiments, the damping posts 440 are configured to transport the heat from the heat sink elements 450 disposed in the inside of the enclosure 215 to the outside of the enclosure 215. In some embodiments, fans (not shown) or other means (not shown) for introducing convective heat transfer to the outer surface of the enclosure 215 may be used to remove heat from the inside of the enclosure 215 while still maintaining an acoustically isolating solution. This solution can be used with all of the enclosure embodiments presently disclosed.

In some embodiments, heat from the inside of the enclosure 215 is removed by making the barrier layer 315 and/or the membranes 325 from good thermal conducting materials such as, for example, metals, aluminum, copper and/or their alloys.

Referring to FIG. 5, in some embodiments, the wall 230 of the enclosure 215 (marked by dotted line) defines a plurality of cavities 510 formed by of the barrier layer 315 and the panel 310. In some embodiments, the cavities 510 are configured to allow the resonators 320 to function by allowing the membranes 325 to deflect into and out of the cavities 510. In one embodiment, an absorber material (not shown) is disposed within one or more cavities 510 to help dissipate any transmitted acoustic energy. In one embodiment, the absorber material disposed within the cavities 510 is porous.

Figure 6:
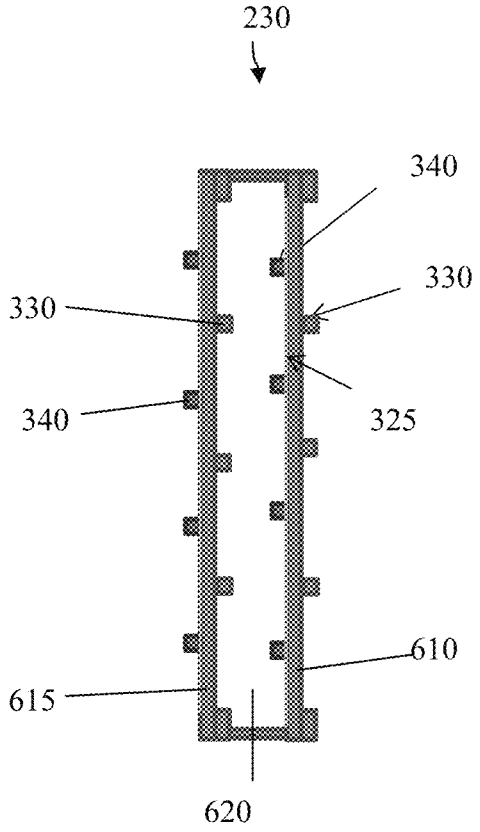
FIG. 6 depicts another embodiment of a wall according to the present disclosure.

Referring to FIG. 6, in some embodiments, the wall 230 of the enclosure 215 (not shown) comprises two barrier layers 610 and 615 coupled together to form a cavity 620. In this embodiment, the grid structure 330 acts as a core layer giving bending stiffness to the overall wall 230. Using two barrier layers 610 and 615 as shown in FIG. 6 provides a number of performance benefits such as, for example, raised frequency panel vibration modes, enhanced acoustic isolation at a single frequency or the ability to target two distinct frequencies that can be matched to the operation of the component to be isolated.

In some embodiments, the enclosure 215 presently disclosed is used as an isolator box that would be placed over the component 110 and rigidly mounted to the floor or wall of another component.

Figure 7:
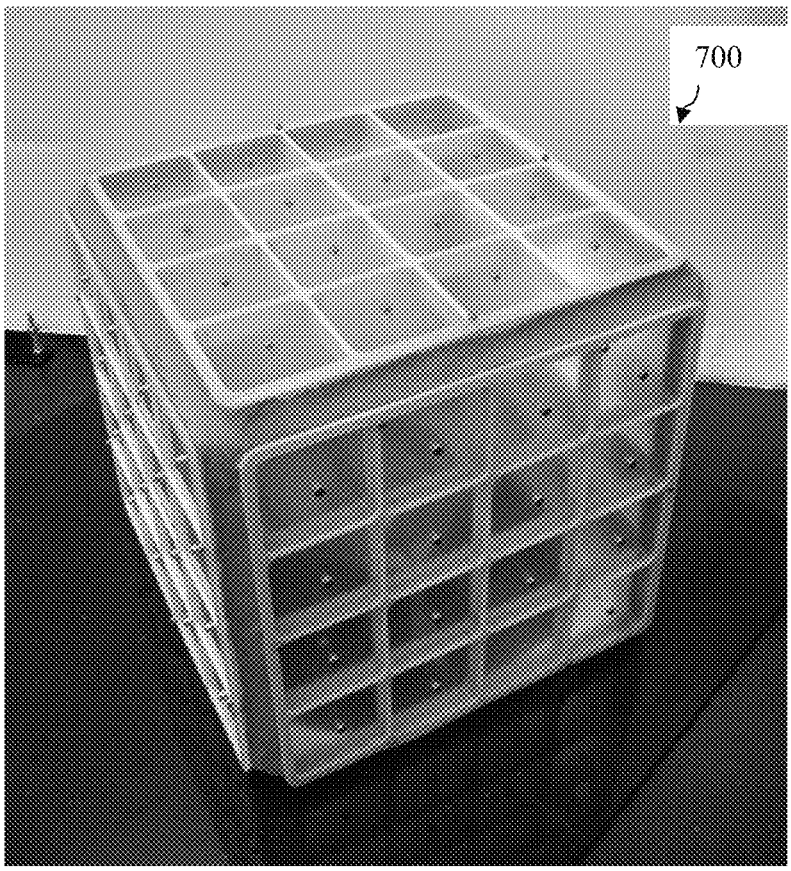
FIG. 7 depicts another embodiment according to the present disclosure.

FIG. 7 shows a proof of concept embodiment of this invention. The 5 sided enclosure 700 can be placed over a noise source to provide acoustic isolation. It uses the sandwich layer construction shown in FIG. 6 with an average area density of 70 oz/yd$^2$. Simple labs tests demonstrated that this prototype solution provided a 20 dB transmission loss near the antiresonant frequency of 500 Hz. This is approximately 10 dB greater than the mass law prediction for a limp isotropic barrier at this frequency showing a significant weight savings over traditional designs.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, component, or step is explicitly recited in the claims. No claim element herein is to be construed under the provisions of 35 U.S.C. Sec. 112, sixth paragraph, unless the element is expressly recited using the phrase "means for . . . " and no method or process step herein is to be construed under those provisions unless the step, or steps, are expressly recited using the phrase "step(s) for . . . ."

What is claimed is:

1. An enclosure comprising:

a plurality of walls coupled together and configured to at least partially cover one or more components, wherein at least one of the walls comprises:

a first plurality of antiresonant membranes configured to at least partially block acoustic emission from the one or more components, and an outer panel or a second plurality of antiresonant membranes, coupled with the first plurality of antiresonant membranes, to form at least one cavity.

2. The enclosure of claim 1, wherein the outer panel is coupled with the first plurality of antiresonant membranes to form the at least one cavity.

3. The enclosure of claim 2, further comprising an absorber material disposed within the at least one cavity.

4. The enclosure of claim 1, wherein the second plurality of antiresonant membranes is coupled with the first plurality of antiresonant membranes to form the at least one cavity.

5. The enclosure of claim 1, wherein at least one antiresonant membrane of the first plurality of antiresonant membranes comprises a mass.

6. The enclosure of claim 5, wherein the at least one antiresonant membrane of the first plurality of antiresonant membranes comprises a ring shaped mass.

7. The enclosure of claim 1, further comprising at least one heat sink to remove at least a portion of heat from the enclosure generated by the one or more components.

8. The enclosure of claim 1, wherein the first plurality of antiresonant membranes comprises metal material.

9. The enclosure of claim 1, wherein the first plurality of antiresonant membranes are configured to create a plurality of reflection frequency bands.

10. A method for blocking acoustic emissions, the method comprising:

providing an enclosure comprising a first plurality of antiresonant membranes configured to at least partially block acoustic emission from one or more components;

at least partially covering the one or more components with the enclosure; and coupling an outer panel or a second plurality of antiresonant membranes with the first plurality of antiresonant membranes to form at least one cavity.

11. The method of claim 10, wherein the coupling of the outer panel or the second plurality of antiresonant membranes with the first plurality of antiresonant membranes comprises coupling the outer panel with the first plurality of antiresonant membranes to form the at least one cavity.

12. The method of claim 11, further comprising providing an absorber material within the at least one cavity.

13. The method of claim 10, wherein the coupling of the outer panel or the second plurality of antiresonant membranes with the first plurality of antiresonant membranes comprises coupling the second plurality of antiresonant membranes with the first plurality of antiresonant membranes to form the at least one cavity.

14. The method of claim 10, further comprising coupling a mass with at least one antiresonant membrane of the first plurality of antiresonant membranes.

15. The method of claim 14, further comprising coupling a ring shaped mass with the at least one antiresonant membrane of the first plurality of antiresonant membranes.

16. The method of claim 10, further comprising removing at least a portion of heat from the enclosure generated by the one or more components using at least one heat sink.

17. The method of claim 10, wherein the first plurality of antiresonant membranes are configured to create a plurality of reflection frequency bands.

18. The enclosure of claim 1, wherein the first plurality of antiresonant membranes reflect acoustic energy.

19. The enclosure of claim 1, wherein the first plurality of antiresonant membranes create antiresonance in at least two separate reflection frequency bands.

20. The enclosure of claim 1, wherein the first plurality of antiresonant membranes comprise elastic material held under tension that controls vibration modes.

21. The enclosure of claim 4, wherein the first plurality of antiresonant membranes and the second plurality of antiresonant membranes are configured to enhance acoustic isolation at a single frequency.

* * * * *